US012167778B2

(12) United States Patent
Chen

(10) Patent No.: US 12,167,778 B2
(45) Date of Patent: Dec. 17, 2024

(54) FASTENING DEVICE

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 0 days.

(21) Appl. No.: 18/276,353

(22) PCT Filed: Mar. 25, 2021

(86) PCT No.: PCT/CN2021/082959
§ 371 (c)(1),
(2) Date: Aug. 8, 2023

(87) PCT Pub. No.: WO2022/165945
PCT Pub. Date: Aug. 11, 2022

(65) Prior Publication Data

US 2024/0122302 A1 Apr. 18, 2024

(30) Foreign Application Priority Data

Feb. 8, 2021 (CN) ..... 202120353704.2

(51) Int. Cl.
*A43C 11/16* (2006.01)

(52) U.S. Cl.
CPC ..... *A43C 11/165* (2013.01)

(58) Field of Classification Search
CPC ..... A43C 11/165; A43C 11/20; A43C 7/00; A61F 5/01; Y10T 24/2183; Y10T 24/3724; A43B 3/26
See application file for complete search history.

(56) References Cited

U.S. PATENT DOCUMENTS

| | | | | |
|---|---|---|---|---|
| 5,333,398 | A * | 8/1994 | Seo | A43C 7/00 24/712.9 |
| 10,413,019 | B2 * | 9/2019 | Soderberg | A43C 11/165 |
| 11,547,182 | B2 * | 1/2023 | Chen | A43D 8/18 |
| 2008/0172848 | A1 * | 7/2008 | Chen | A43C 11/165 24/68 SK |
| 2021/0196000 | A1 * | 7/2021 | Trudel | A43C 7/08 |

* cited by examiner

*Primary Examiner* — Robert Sandy
*Assistant Examiner* — Louis A Mercado
(74) *Attorney, Agent, or Firm* — CKC & Partners Co., LLC

(57) ABSTRACT

A fastening device is applied for being installed at an article and includes a base, a coupling member and a reel member. The base is located at the article and includes a bottom cover and a rotating plate, the bottom cover includes a bore, and the rotating plate is movably coupled to the bottom cover. The coupling member inserts an installing hole of the article and the bore, the coupling member is coupled to the rotating plate, and the reel member is coupled to a lace and disposed at the base. The rotating plate is rotated to move the coupling member in the bore, thereby narrowing a gap between the base and the article.

7 Claims, 17 Drawing Sheets

FASTENING DEVICE

RELATED APPLICATIONS

This application is a U.S. National Phase application of International application No. PCT/CN2021/082959, filed Mar. 25, 2021, which claims the benefits of priority of CN application No. 202120353704.2 filed on Feb. 8, 2021, the content of which are incorporated herein by reference.

BACKGROUND

Technical Field

The present disclosure relates to a fastening device, and more particularly, the present disclosure relates to a fastening device for being installed at an article.

Description of Related Art

Generally, a wearable article may include a first side and a second side, the second side may be opposite to the first side, and the first side and the second side may be close to each other to secure the wearable article at the worn portion. Taken a shoe as an example, it can further include a tongue, the tongue is located between the first side and the second side, and the shoe further includes a plurality of eyelets arranged at the first side and the second side, and a conventional shoe lace may be knotted after passing through the eyelets to fasten the article.

However, the shoe lace has to be loosened before the shoe is taken off, the shoe lace has to be knotted again as the shoe is put on, and therefore lots of inconveniences come. In order to solve the aforementioned problems, some practitioners developed a fastening device, which may be disposed at the tongue and coupled to a lace, and the lace may pass through the eyelets to substitute for the shoe lace. Through operating the fastening device, the lace may be rapidly tensioned or released, and the shoe may be easily taken off or put on.

Unfortunately, this kind of fastening device is secured at the tongue during the post process of the shoe. In other words, if the shoe itself is not configured to be a state that includes the fastening device, it is hard for a user to couple the fastening device to the shoe. Therefore some practitioners developed another new fastening device, which includes a positioning sheet, the positioning sheet includes a plurality of positioning holes, the lace may pass through the eyelets and the positioning holes, and then be coupled to the reel member of the fastening device, and the fastening device can be coupled to the shoe. However, as the user releases the lace, a gap is generated between the positioning sheet and the shoe, and a vibration occurs, thereby bringing inconveniences in usage.

In order to solve the problem, some practitioners drill holes on the shoe, and then the fastening device is secured at the shoe, but the types or the thicknesses of the shoes are different, there are problems of lacking installation stability and flexibility, and the aforementioned problems also exist in other wearable articles in addition to the shoes.

Based on the aforementioned, how to improve the structure of the fastening device and the flexibility and stability thereof as being installed at the articles becomes a target that those in the field pursue.

SUMMARY

According to one embodiment of the present disclosure a fastening device is provided, which is applied for being installed at an article, and the fastening device includes a base, a coupling member and a reel member. The base is located at the article and includes a bottom cover and a rotating plate, the bottom cover includes a bore, and the rotating plate is movably coupled to the bottom cover. The coupling member inserts an installing hole of the article and the bore, the coupling member is coupled to the rotating plate, and the reel member is coupled to a lace and disposed at the base. The rotating plate is rotated to move the coupling member in the bore, thereby narrowing a gap between the base and the article.

DETAILED DESCRIPTION

Figure 1:
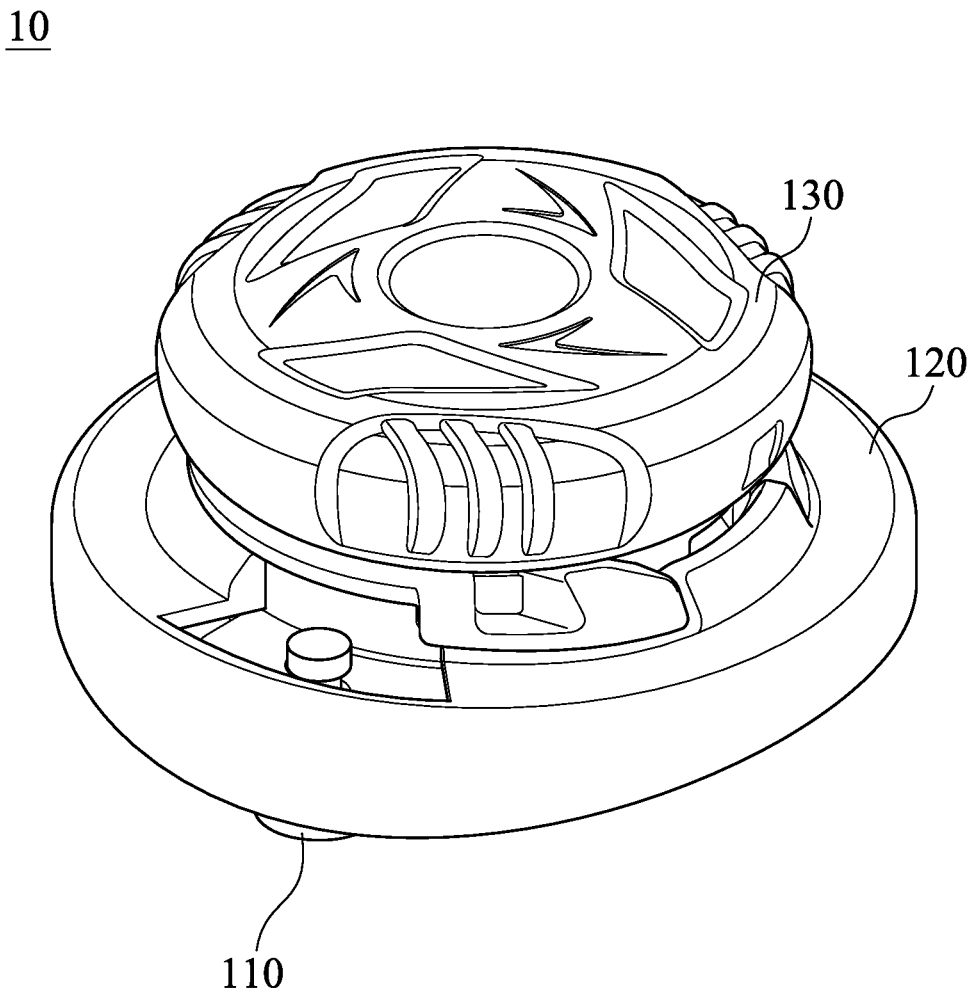
FIG. 1 shows a three-dimensional schematic view of a fastening device according to a first embodiment of the present disclosure.

The embodiments of the present disclosure will be illustrated with drawings hereinafter. In order to clearly describe the content, many practical details will be mentioned with the description hereinafter. However, it will be understood by the reader that the practical details will not limit the present disclosure. In other words, in some embodiment of the present disclosure, the practical details are not necessary. Additionally, in order to simplify the drawings, some conventional structures and elements will be illustrated in the drawings in a simple way; the repeated elements may be labeled by the same or similar reference numerals.

In addition, when an element (or mechanism or module) in the present disclosure is referred to as being "connected to", "disposed on" or "coupled to" another element, it can be directly connected to, disposed on or coupled to another element, or it can be indirectly connected to, disposed on or coupled to another element, that is, intervening elements being present between the element and the another element. In contrast, when an element is referred to as being "directly connected to", "directly disposed on" or "directly coupled to" another element, there are no intervening elements present between the element and the another element. The terms first, second, third, etc. are used herein to describe various elements or components, and these elements/components should not be limited by these terms. Consequently, a first element/component discussed below could be termed a second element/component. Moreover, the combinations of the elements/components/mechanisms/modules are not well-known, ordinary or conventional combinations, and whether the combinations can be easily completed by the one skilled in the art cannot be judged based on whether the elements/components/mechanisms/modules themselves are well-known, ordinary or conventional.

Figure 2:
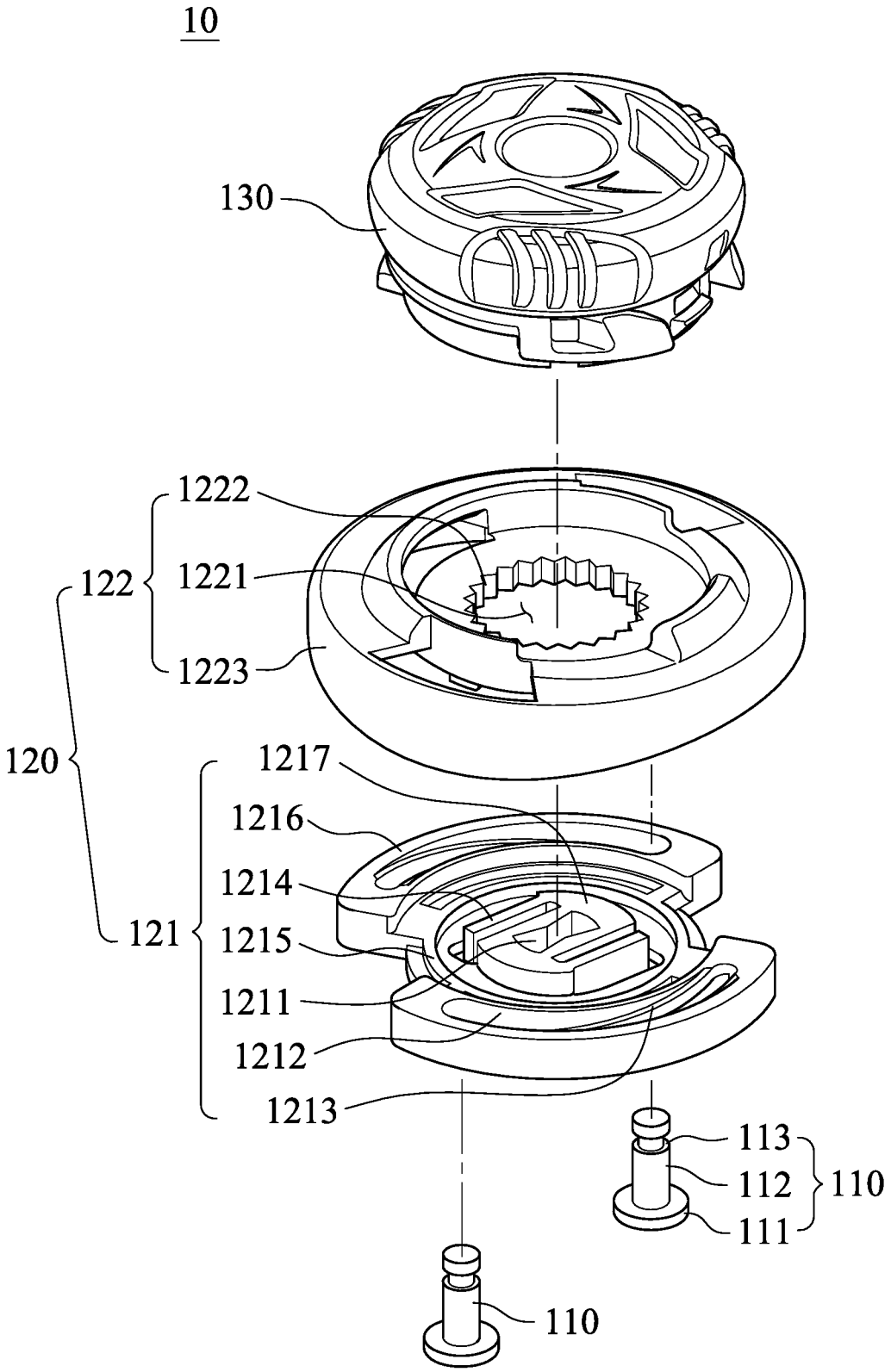
FIG. 2 shows one exploded view of the fastening device of the first embodiment of FIG. 1.
Figure 3:
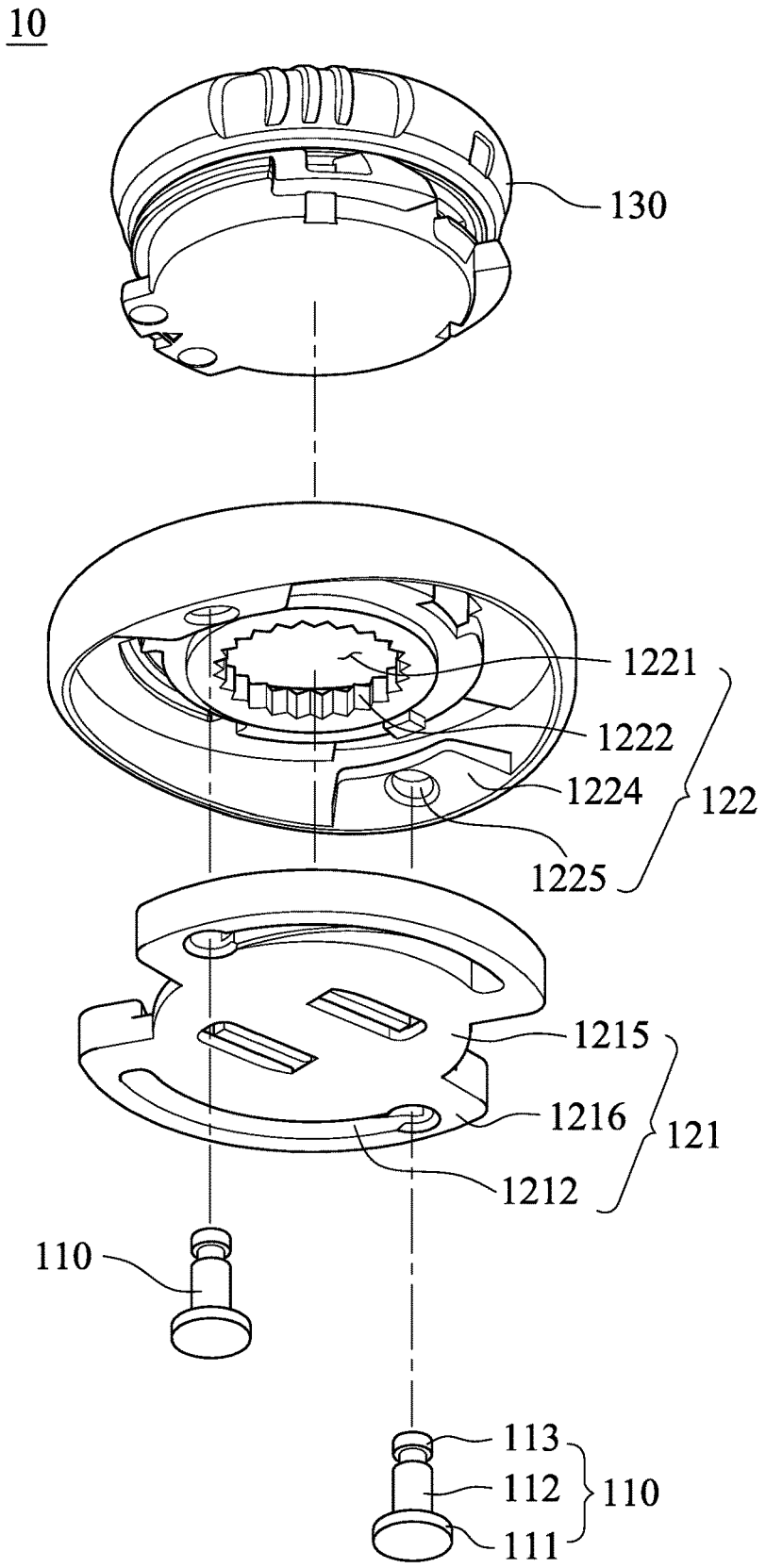
FIG. 3 shows another exploded view of the fastening device of the first embodiment of FIG. 1.

Please refer to FIG. 1, FIG. 2 and FIG. 3, FIG. 1 shows a three-dimensional schematic view of a fastening device 10 according to a first embodiment of the present disclosure, FIG. 2 shows one exploded view of the fastening device 10 of the first embodiment of FIG. 1, and FIG. 3 shows another exploded view of the fastening device 10 of the first embodiment of FIG. 1. The fastening device 10 is applied to be installed at an article S1 (shown in FIG. 8), which includes a base 120, a coupling member 110 and a reel member 130. The base 120 is located at the article S1 and includes a bottom cover 122 and a rotating plate 121, the bottom cover 122 includes a bore 1225, and the rotating plate 121 is movably coupled to the bottom cover 122. The coupling member 110 inserts an installing hole H1 (shown in FIG. 8) of the article S1 and the bore 1225, the coupling member 110 is coupled to the rotating plate 121, and the reel member 130 is coupled to a lace (not shown in the first embodiment) and disposed at the base 120. The rotating plate 121 is rotated to move the coupling member 110 in the bore 1225, thereby narrowing a gap G1 (shown in FIG. 8) between the base 120 and the article S1.

Therefore, through the configuration of the bottom cover 122, the rotating plate 121 and the coupling member 110, the gap G1 between the base 120 and the article S1 may be narrowed, which fabricates for the fastening device 10 to be installed at the articles S1 with different types or thicknesses, and in addition to increase the installation flexibility, the installation stability may also be increased. The details of the fastening device 10 will be described hereinafter.

The bottom cover 122 may include a covering portion 1223 and two blocking sheets 1224, the inner region of the covering portion 1223 forms a lower chamber for receiving the rotating plate 121, the two blocking sheets 1224 respectively extend radially and inward from a bottom edge of the covering portion 1223 and are arranged symmetrically, and the two bores 1225 respectively penetrate the two blocking sheets 1224.

The rotating plate 121 may include a disc 1215 and two wings 1216, and the two wings 1216 are connected to two sides of the disc 1215 and arranged symmetrically. The rotating plate 121 may further include a guiding curved-hole 1212 and an engaging thread 1213, the guiding curved-hole 1212 is configured for the coupling member 110 to insert thereinto, the engaging thread 1213 protrudes from an inner wall (not labeled) of the guiding curved-hole 1212 and is coupled to the coupling member 110, the engaging thread 1213 includes a higher end P2 (labeled in FIG. 4) and a lower end P1 (labeled in FIG. 4), and a distance D2 (labeled in FIG. 7) between the higher end P2 and a bottom surface 1218 of the rotating plate 121 is wider than a distance D1 (labeled in FIG. 5) between the lower end P1 and the bottom surface 1218. As the rotating plate 121 is rotated, the coupling member 110 is moved relative to the rotating plate 121 from the lower end P1 to the higher end P2.

Precisely, a number of the guiding curved-holes 1212 is two and the guiding curved-holes 1212 respectively penetrate the two wings 1216, a number of the engaging threads 1213 is two, the two engaging threads 1213 respectively protrude inward from the inner side walls of two sides of the guiding curved-hole 1212, and each engaging thread 1213 climbs upward from a bottom of the inner side wall along an axial direction I1 (labeled in FIG. 5), thereby forming the lower end P1 and the higher end P2 with height difference in the axial direction I1.

As shown in FIGS. 2 and 3, the bottom cover 122 may further include a central hole 1221 and a plurality of depressions 1222, and the depressions 1222 are located at an inner surface of the central hole 1221; the rotating plate 121 may further include at least one pawl arm 1214, which is selectively engaged with at least one of the depressions 1222; the at least one pawl arm 1214 is disengaged from the at least one of the depressions 1222 as being forced, thereby allowing the rotating plate 121 to rotate relative to the bottom cover 122.

The top of the covering portion 1223 is depressed inward to form an upper chamber, the upper chamber is for the reel member 130 to be installed therein, and the central hole 1221 penetrates a bottom wall of the upper chamber to allow the upper chamber to be communicated with the lower chamber. The rotating plate 121 may further include a boss 1217, the boss 1217 is located on the disc 1215 and is higher than a top surface of the disc 1215, a number of the at least one pawl arm 1214 is two, and the two pawl arms 1214 are respectively connected to two sides of the boss 1217 and arranged symmetrically. As the user exerts a force to rotate the rotating plate 121 in a first direction R1 (labeled in FIG. 4), the pawl arms 1214 are disengaged from the depressions 1222, and the coupling member 110 may be moved relative to the guiding curved-hole 1212; on the contrary, as the force is removed, the pawl arms 1214 are engaged with the depressions 1222, rotating of the rotating plate 121 in a second direction R2 (labeled in FIG. 4) is prohibited.

The rotating plate 121 may further include a locking hole 1211, which is disposed at the boss 1217, the locking hole 1211 may be configured for an engaging projection T12 (shown in FIG. 8) of a tool T1 (shown in FIG. 8) to be inserted thereinto, and therefore the user may use the tool T1 to rotate the rotating plate 121, thereby having a strength-saving effect.

As assembling the rotating plate 121 and the base 120, the wings 1216 and the blocking sheets 1224 are mismatched to each other, the rotating plate 121 may be put upward into the lower chamber of the bottom cover 122, at this time the boss 1217 and the pawl arms 1214 protrude into the central hole 1221, the two pawl arms 1214 are engaged with two depressions 1222, rotating the rotating plate 121 in the first direction R1 may allow the wings 1216 to align with the blocking sheets 1224, and separation of the rotating plate 121 may be avoided, thereby allowing the bore 1225 to be respectively communicated with the guiding curved-hole 1212 at the same time.

In the first embodiment, the coupling member 110 may include an engaging cavity 113, and the engaging cavity 113 is coupled to the engaging thread 1213, thereby fabricating for the association between the coupling member 110 and the guiding curved-hole 1212. The coupling member 110 may further include a head portion 111 and a bar portion 112, the bar portion 112 is connected to the head portion 111, a diameter of the bar portion 112 is smaller than a diameter of the head portion 111, such that the head portion 111 has a restricting function, and the engaging cavity 113 is located at the bar portion 112 and is far away from the head portion 111.

Figure 4:
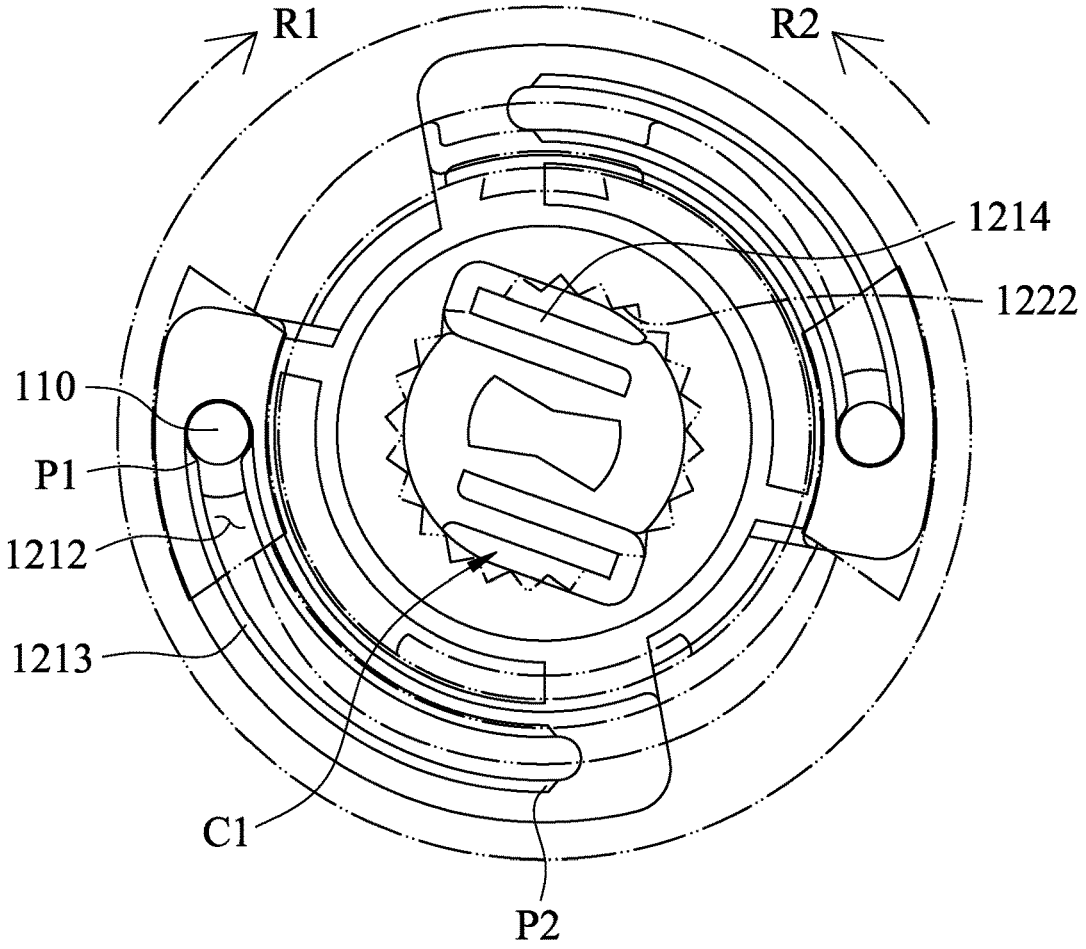
FIG. 4 shows one top view of a base and a coupling member of the fastening device of the first embodiment of FIG. 1.
Figure 5:
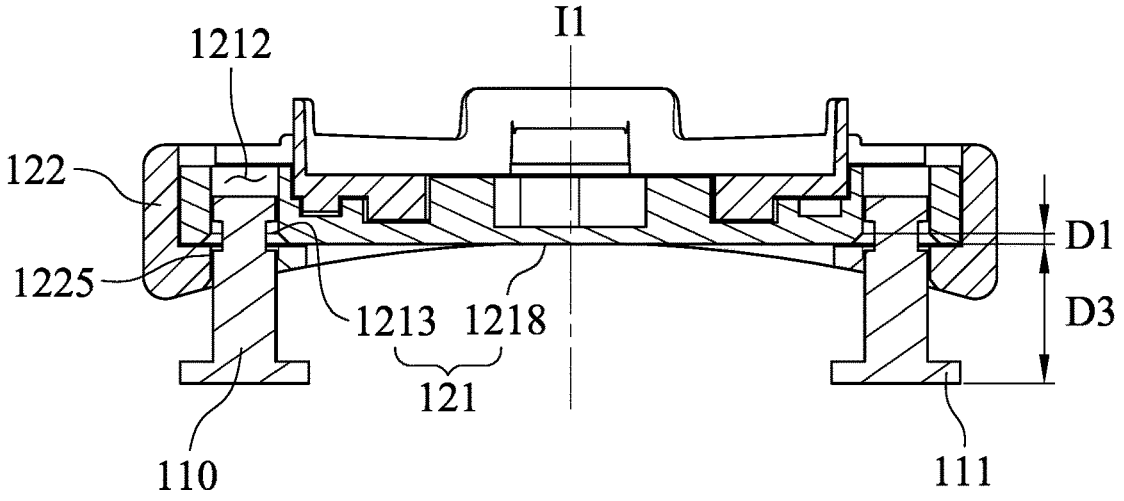
FIG. 5 shows one cross-section side view of the base and the coupling member of the fastening device of the first embodiment of FIG. 1.
Figure 6:
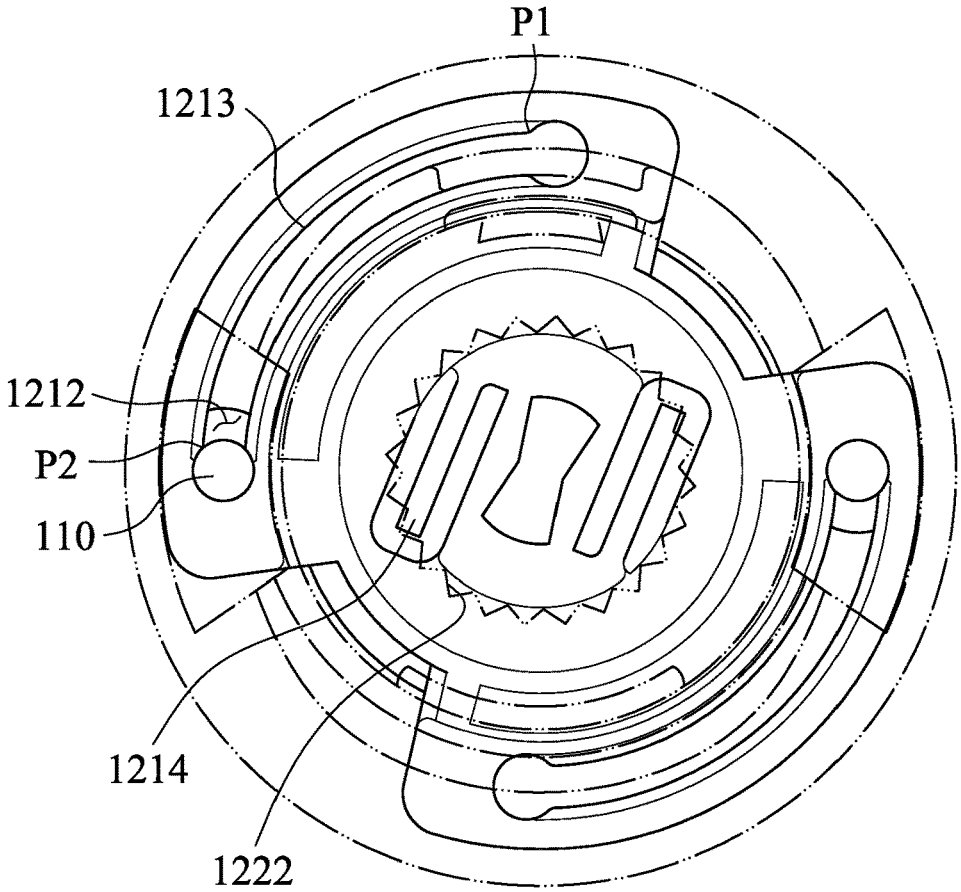
FIG. 6 shows another top view of the base and the coupling member of the fastening device of the first embodiment of FIG. 1.
Figure 7:
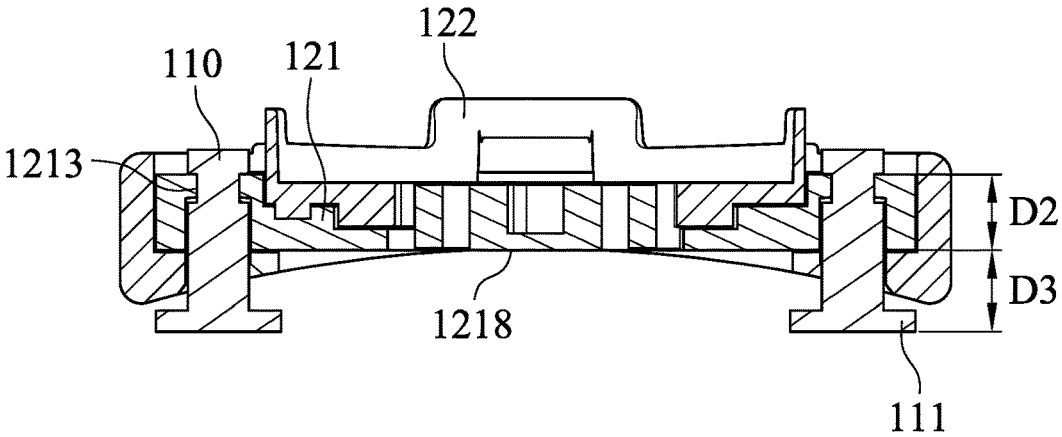
FIG. 7 shows another cross-section side view of the base and the coupling member of the fastening device of the first embodiment of FIG. 1.

Please refer to FIG. 4, FIG. 5, FIG. 6 and FIG. 7, FIG. 4 shows one top view of a base 120 and a coupling member 110 of the fastening device 10 of the first embodiment of FIG. 1, FIG. 5 shows one cross-section side view of the base 120 and the coupling member 110 of the fastening device 10 of the first embodiment of FIG. 1, FIG. 6 shows another top view of the base 120 and the coupling member 110 of the fastening device 10 of the first embodiment of FIG. 1, and FIG. 7 shows another cross-section side view of the base 120 and the coupling member 110 of the fastening device 10 of the first embodiment of FIG. 1. It is noted that, in FIGS. 4 to 7, the fastening device 10 is not coupled to the article S1, the positions and operations between the coupling member 110, the rotating plate 121 and the bottom cover 122 are illustrated, but the present disclosure is not limited thereto.

As shown in FIGS. 4 and 5, the coupling member 110 is located at the lower end P1 at this time, and since the distance D1 between the lower end P1 and the bottom surface 1218 is smaller, the distance D3 between the head portion 111 of the coupling member 110 and the bottom surface 1218 is larger; on the contrary, as the rotating plate 121 and the guiding curved-hole 1212 are rotated relative to the bottom cover 122, because the coupling member 110 is restricted by the bore 1225, it can only move upward by the guidance of the engaging thread 1213, as shown in FIGS. 6 and 7, the coupling member 110 is switched to the higher end P2, and since the distance D2 between the higher end P2 and the bottom surface 1218 is wider than the distance D1, the distance D3 between the head portion 111 of the coupling member 110 and the bottom surface 1218 is shortened.

Figure 8:
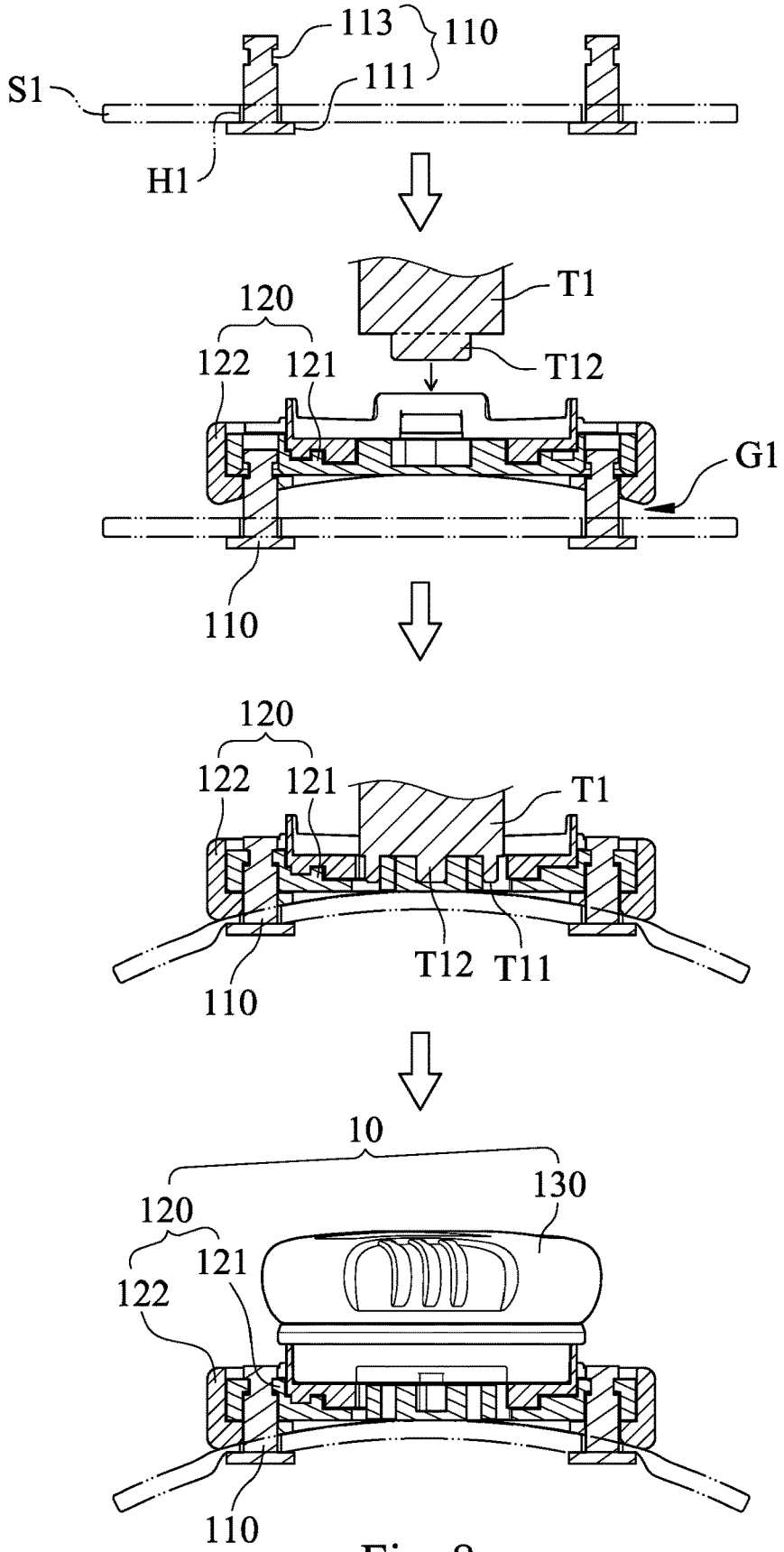
FIG. 8 shows an operation illustrating the fastening device of the first embodiment of FIG. 1 being installed at an article.

Please refer to FIG. 8, with references of FIGS. 5 and 7, FIG. 8 shows an operation illustrating the fastening device 10 of the first embodiment of FIG. 1 being installed at an article S1. Since the distance D3 between the head portion 111 of the coupling member 110 and the bottom surface 1218 may be shortened, the fastening device 10 may be installed at the articles S1 with different types and thicknesses. As shown in FIG. 8, the coupling member 110 may be inserted into the installing hole H1 first, and the engaging cavity 113 may be located at one side of the installing hole H1, while the head portion 111 is restricted at the other side of the installing hole H1. After which, the base 120 may be coupled to the coupling member 110, and the coupling member 110 passes through the bore 1225 into the guiding curved-hole 1212, such that the engaging cavity 113 is coupled to the engaging thread 1213. The tool T1 may be inserted into the rotating plate 121, rotating the rotating plate 121 may move the coupling member 110 upward, the gap G1 between the base 120 and the article S1 may be narrowed, as the gap G1 is narrowed to zero, the base 120 may be firmly associated with the article S1, and finally, the reel member 130 may be installed at the base 120. It is noted that, the tool T1 may further include two finger portions T11, the two finger portions T11 may be insert into an unlock space C1 (labeled in FIG. 4), and the pawl arms 1214 may then be deflected from the depressions 1222, such that the pawl arms 1214 are disengaged from the depressions 1222, thereby fabricating for rotating the rotating plate 121. In another embodiment, the tool may not include the engaging protrusion, only two finger portions are included and are inserted into the unlock space, and the effect of coupling the rotating plate may also be achieved.

If the fastening device 10 is removed from the article S1, the reel member 130 may be separated from the base 120 first, the tool T1 may then be inserted, since the tool T1 includes the two finger portions T11 for deflecting the pawl arms 1214 to prevent the pawl arms 1214 to engage with the depressions 1222, rotating the tool T1 may rotate the rotating plate 121 in the second direction R2 (labeled in FIG. 4), such that the coupling member 110 is switched to the lower end P1, and finally the coupling member 110 is separated from the base 120.

Figure 9:
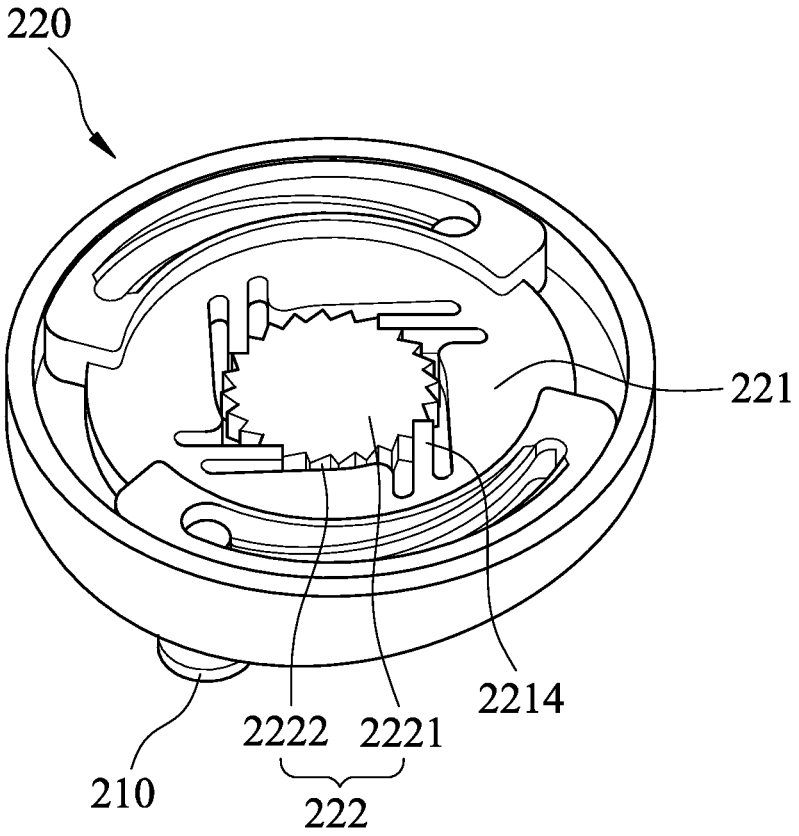
FIG. 9 shows a three-dimensional schematic view of a base and a coupling member of a fastening device according to a second embodiment of the present disclosure.
Figure 10:
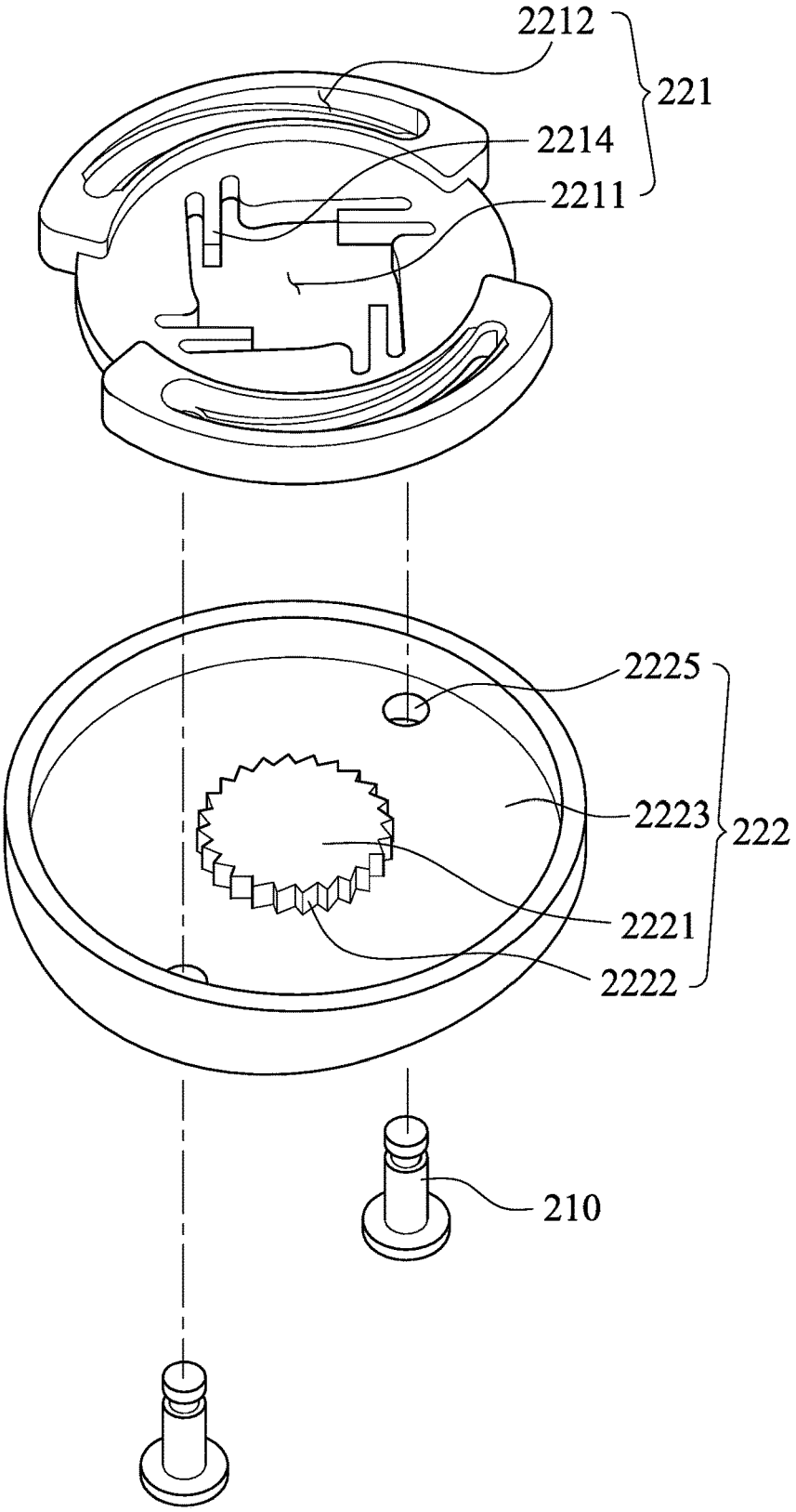
FIG. 10 shows an exploded view of the base and the coupling member of the second embodiment of FIG. 9.

Please refer to FIG. 9 and FIG. 10, FIG. 9 shows a three-dimensional schematic view of a base 220 and a coupling member 210 of a fastening device according to a second embodiment of the present disclosure, and FIG. 10 shows an exploded view of the base 220 and the coupling member 210 of the second embodiment of FIG. 9. The bottom cover 222 may further include a central protrusion 2221 and a plurality of depressions 2222, and the depressions 2222 are located at an outer surface of the central protrusion 2221; the rotating plate 221 further includes at least one pawl arm 2214, which is selectively engaged with at least one of the depressions 2222; the at least one pawl arm 2214 is disengaged from the at least one of the depressions 2222 as being forced, thereby allowing the rotating plate 221 to rotate relative to the bottom cover 222.

The central protrusion 2221 protrudes upward from a bottom wall 2223 of the bottom cover 222, and the two bores 2225 penetrate the bottom wall 2223 and are arranged symmetrically. The rotating plate 221 includes a central through hole 2211, a number of the pawl arms 2214 is two and the pawl arms 2214 protrude inward from an inner surface of the central through hole 2211. During installation, the rotating plate 221 may be directly put into the bottom cover 222, the central protrusion 2221 protrudes into the central through hole 2211 to allow the pawl arm 2214 to engage with at least one of the depressions 2222, and rotating the rotating plate 221 or the bottom cover 222 may align the guiding curved-hole 2212 with the bore 2225, thereby configured for the coupling member 210 to insert into the guiding curved-hole 2212 and the bore 2225. Other details similar to the first embodiment will not be repeated.

Figure 11:
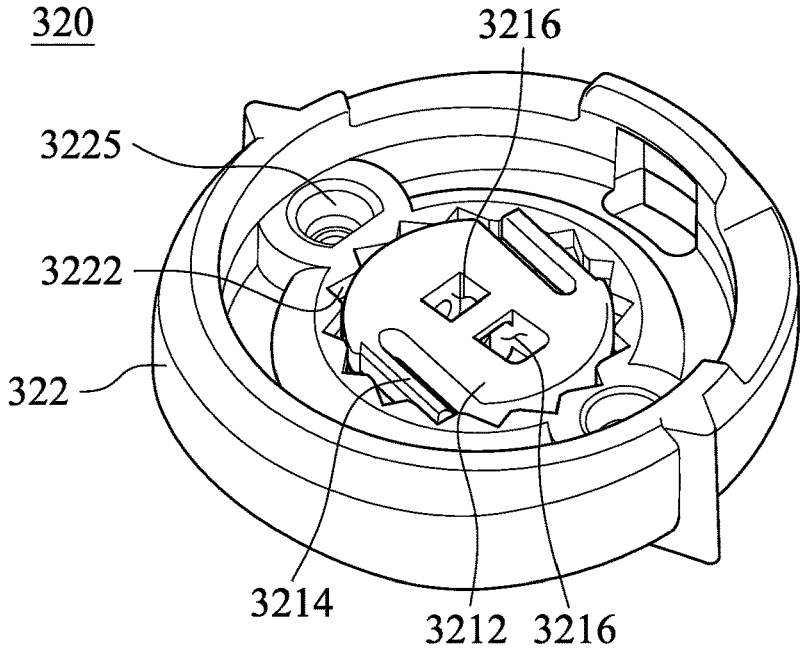
FIG. 11 shows a three-dimensional schematic view of a base of a fastening device according to a third embodiment of the present disclosure.
Figure 12:
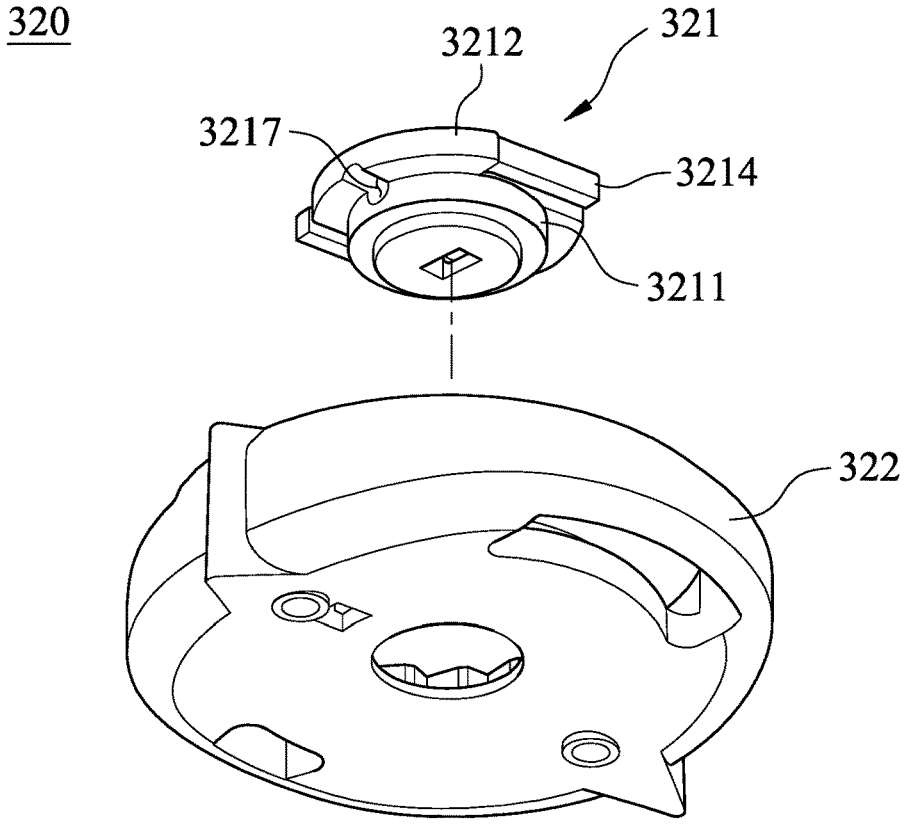
FIG. 12 shows an exploded view of the base of the third embodiment of FIG. 11.
Figure 13:
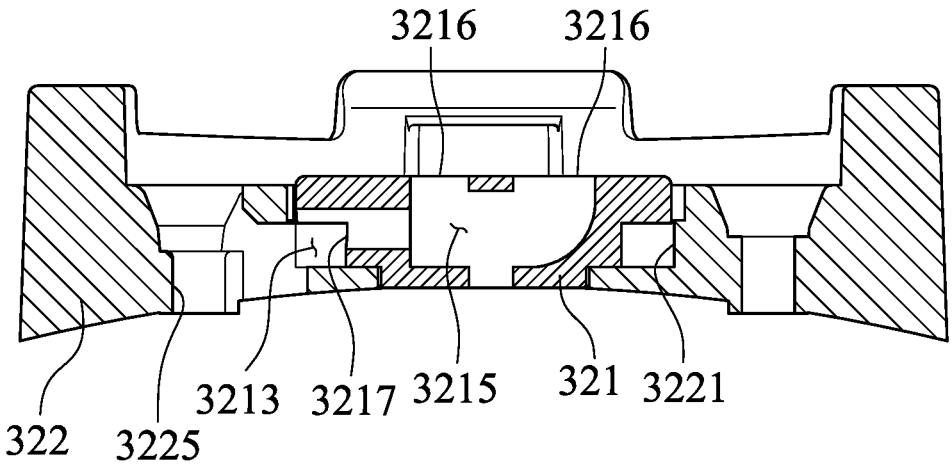
FIG. 13 shows a cross-section side view of the base of the third embodiment of FIG. 11.

Please refer to FIG. 11, FIG. 12 and FIG. 13, FIG. 11 shows a three-dimensional schematic view of a base 320 of a fastening device 30 (labeled in FIG. 14) according to a third embodiment of the present disclosure, FIG. 12 shows an exploded view of the base 320 of the third embodiment of FIG. 11, and FIG. 13 shows a cross-section side view of the base 320 of the third embodiment of FIG. 11.

The bottom cover 322 includes a central cavity (not labeled), a plurality of depressions 3222 and two bores 3225, the depressions 3222 are located at a top end of an inner annular wall 3221 of the central cavity, the two bores 3225 are respectively located at two sides of the central cavity and penetrate a bottom wall (not labeled) of the bottom cover 322, and one of the bores 3225 may be communicated with an inner region of the central cavity.

The rotating plate 321 is received in the inner region of the central cavity, and the coupling member 310 (shown in FIG. 14) may have a cord structure and is wound around the rotating plate 321, and as the rotating plate 321 is rotated, the coupling member 310 is tensioned or released by the rotating plate 321.

Specifically, the rotating plate 321 includes a top portion 3212 and a shaft portion 3211, the shaft portion 3211 is connected to the top portion 3212, a diameter of the top portion 3212 is wider than a diameter of the shaft portion 3211, and as the rotating plate 321 is put into the central cavity, the space between the shaft portion 3211 and the inner annular wall 3221 forms a winding track 3213.

The rotating plate 321 may further include an inserted passage 3215, which is communicated with the bore 3225 and an external ambience (not labeled), and the inserted passage 3215 is configured for receiving the coupling member 310. As shown in FIG. 13, the inserted passage 3215 penetrates the rotating plate 321, such that two top openings 3216 are formed at the top portion 3212 and one side opening 3217 is formed at the side surface, the inserted passage 3215 includes a large-diameter region (not labeled) and a small-diameter region connected to each other, the large-diameter region is close to the top opening 3216, and the small-diameter region is close to the side opening 3217. Hence, the bore 3225, the winding track 3213, the side opening 3217, the inserted passage 3215 and the top opening 3216 are communicated therewith.

In addition, the rotating plate 321 may include two pawl arms 3214, the two pawl arms 3214 are respectively connected to two sides of the top portion 3212 and selectively engaged with at least one of the depressions 3222, and the relation between the pawl arm 3214 and the depression 3222 is similar to the relation between the pawl arm 1214 and the depression 1222, which will not be repeated.

Figure 14:
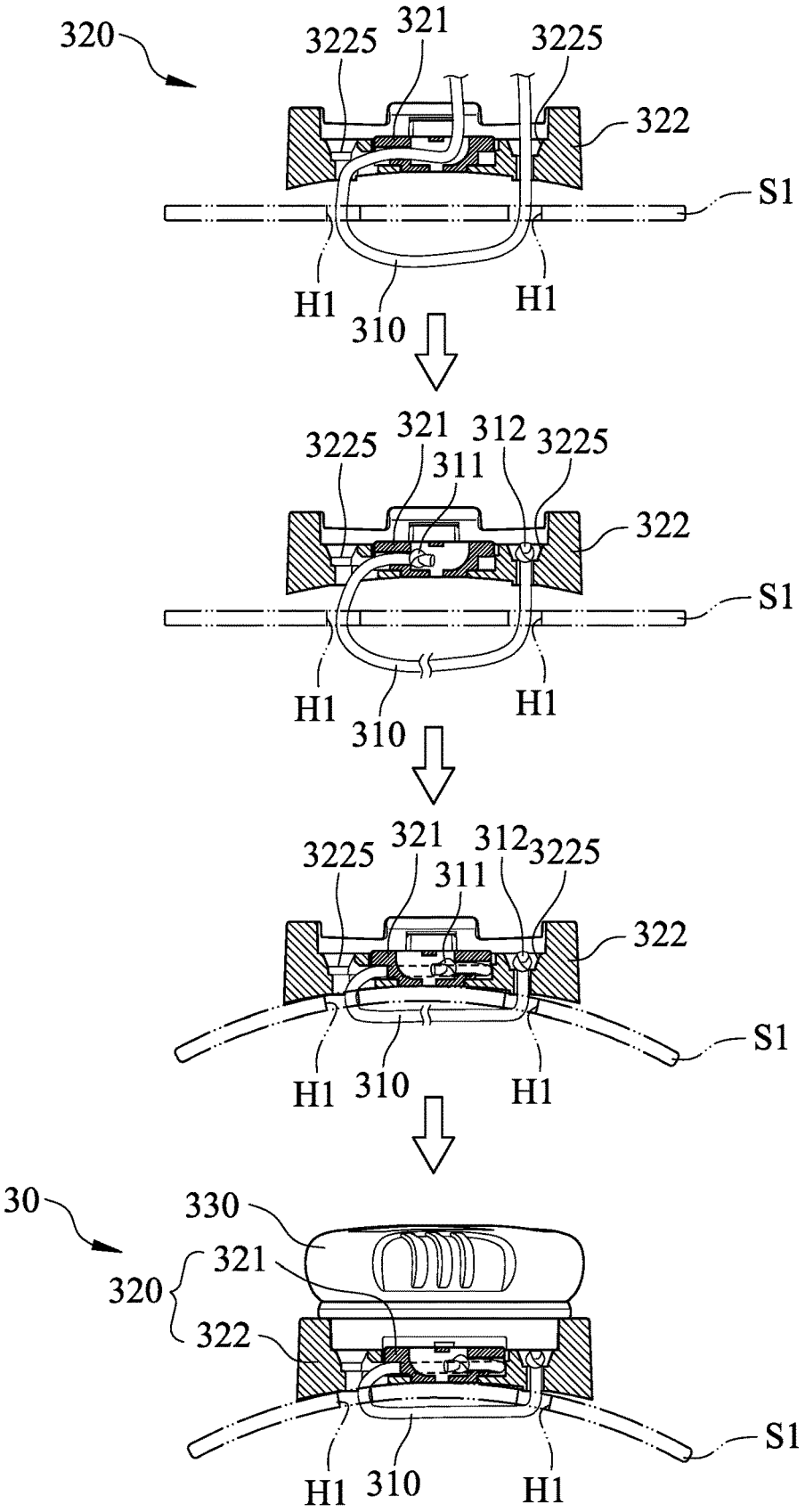
FIG. 14 shows an operation illustrating the fastening device of the third embodiment of FIG. 11 being installed at an article.

Please refer to FIG. 14, with reference of FIG. 13, FIG. 14 shows an operation illustrating the fastening device 30 of the third embodiment of FIG. 11 being installed at an article S1. In the beginning, two ends of the coupling member 310 may be respectively inserted into two installing holes H1 of the article S1, one end of the coupling member 310 passes through one of the bores 3225 to enter the winding track 3213, and then passes through the side opening 3217, the inserted passage 3215 and one of the top openings 3216 to arrive the external ambience, and the other end of the coupling member 310 passes through the other one of the bores 3225 to arrive the external ambience. In other words, the two ends of the coupling member 310 both expose from the base 320.

Continuously, the two ends of the coupling member 310 are knotted to form knots 311, 312, the knot 311 may be restricted in the large-diameter region to allow the coupling member 310 to couple to the rotating plate 321, the knot 312 may be restricted at the bore 3225, and the coupling member 310 may not separate from the rotating plate 321 and the bottom cover 322. Meanwhile, the user may use a tool (not shown in FIG. 14) to rotated the rotating plate 321, the coupling member 310 is driven by the rotating plate 321, thereby winding around the winding track 3213, the gap (not labeled) between the base 320 and the article S1 is narrowed, the base 320 may be firmly associated with the article S1, and finally, the reel member 330 may be installed on the base 320.

Figure 15:
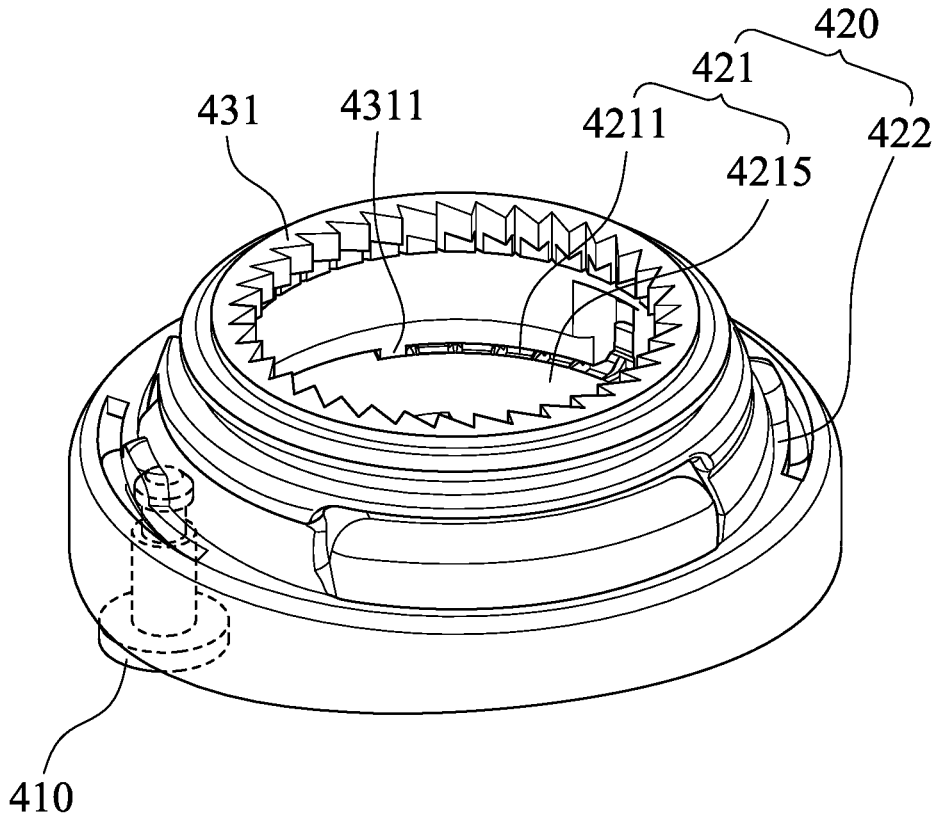
FIG. 15 shows a three-dimensional schematic view of a base, a coupling member and a housing of a fastening device according to a fourth embodiment of the present disclosure.
Figure 16:
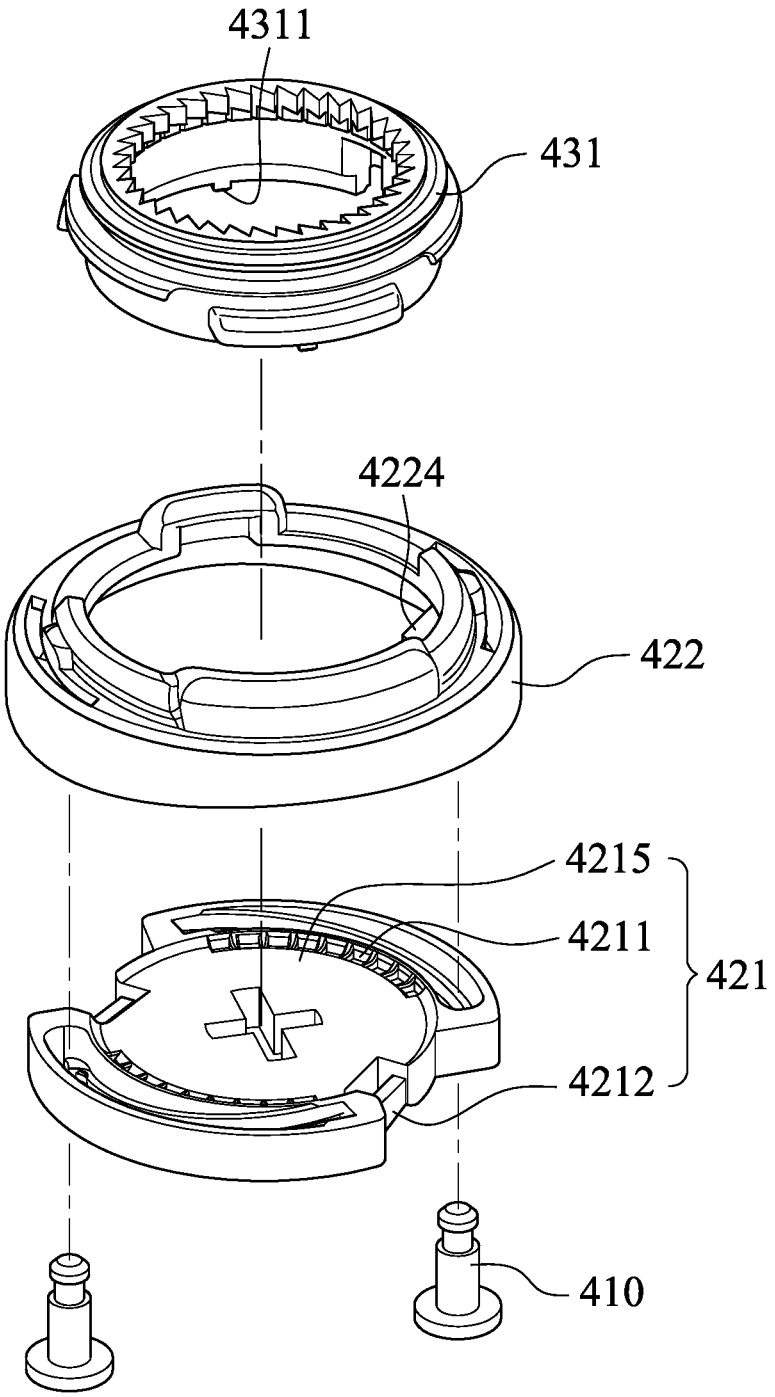
FIG. 16 shows one exploded view of the base, the coupling member and the housing of the fourth embodiment of FIG. 15.
Figure 17:
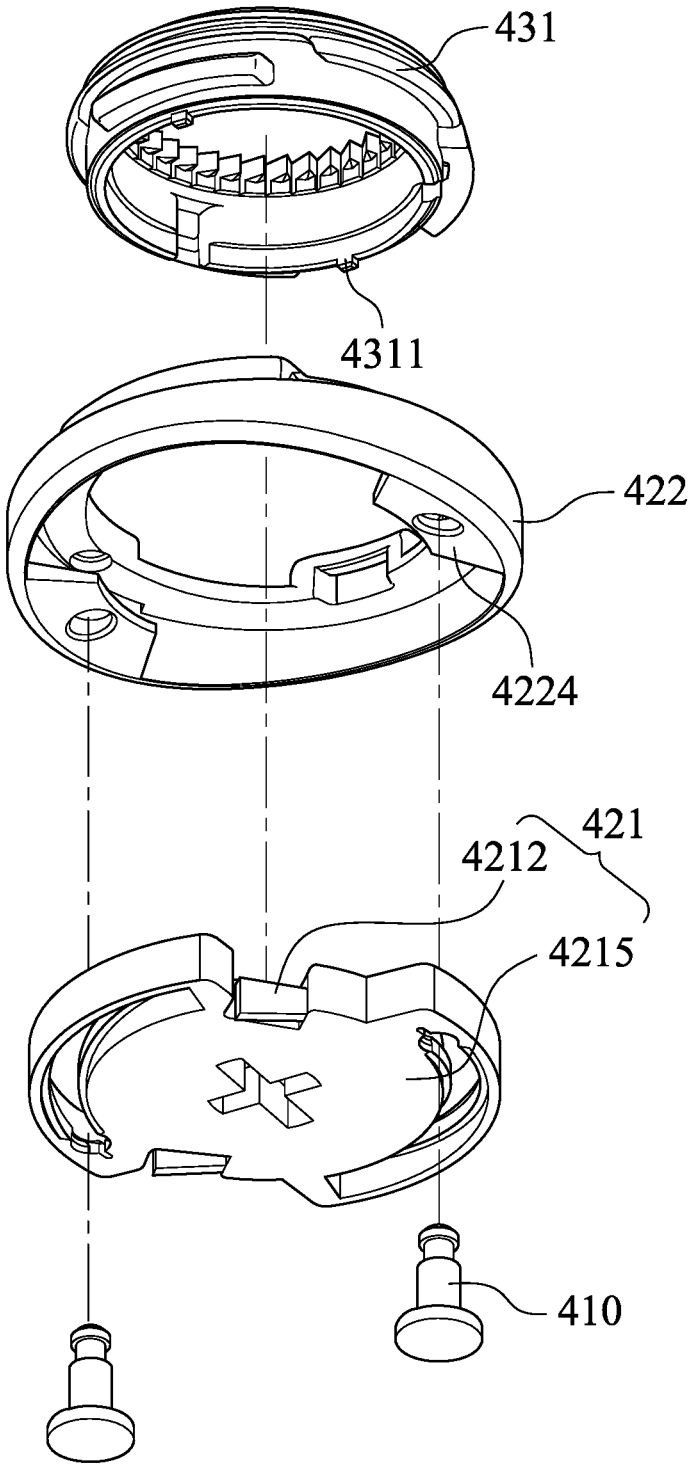
FIG. 17 shows another exploded view of the base, the coupling member and the housing of the fourth embodiment of FIG. 15.
Figure 18:
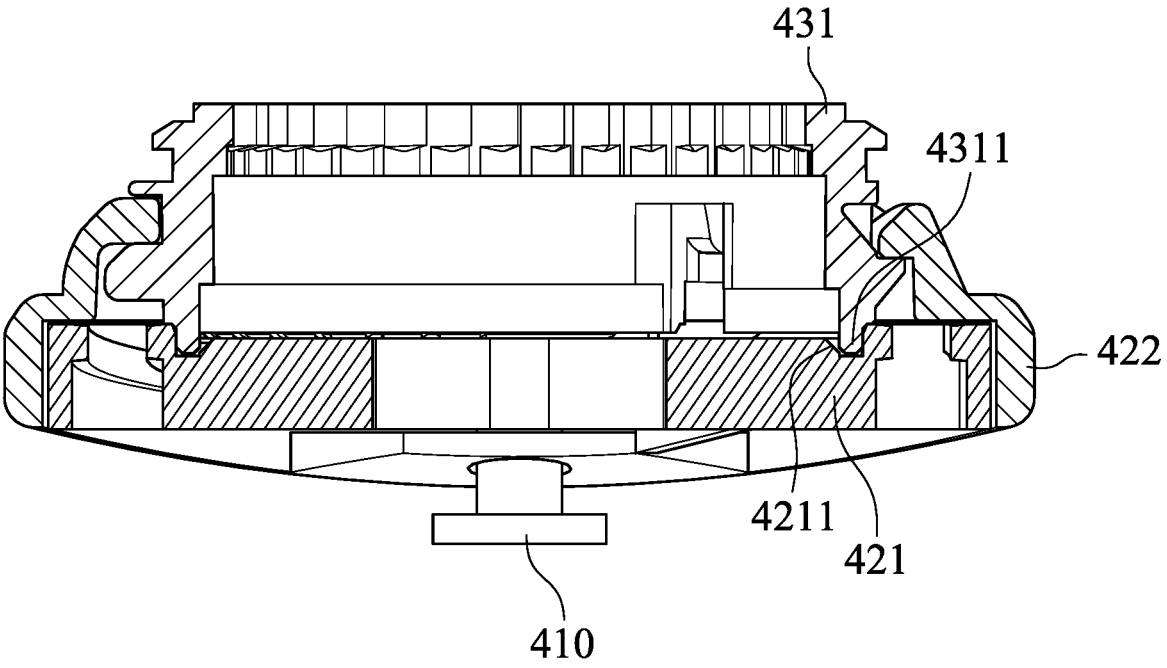
FIG. 18 shows a cross-section side view of the base, the coupling member and the housing of the fourth embodiment of FIG. 15.

Please refer to FIG. 15, FIG. 16, FIG. 17 and FIG. 18, FIG. 15 shows a three-dimensional schematic view of a base 420, a coupling member 410 and a housing 431 of a fastening device according to a fourth embodiment of the present disclosure, FIG. 16 shows one exploded view of the base 420, the coupling member 410 and the housing 431 of the fourth embodiment of FIG. 15, FIG. 17 shows another exploded view of the base 420, the coupling member 410 and the housing 431 of the fourth embodiment of FIG. 15, and FIG. 18 shows a cross-section side view of the base 420, and the coupling member 410 and the housing 431 of the fourth embodiment of FIG. 15. The housing 431 is a part of the reel member (not shown), which is disposed at the base 420, other parts of the reel member are omitted in FIGS. 15 to 18, only the difference between the fourth embodiment and the first embodiment will be mentioned, and similar details between the fourth embodiment and the first embodiment will not be repeated.

The base 420 includes a bottom cover 422 and a rotating plate 421, the rotating plate 421 is assembled with the bottom cover 422, the rotating plate 421 may include a plurality of grooves 4211, and the grooves 4211 are disposed at the disc 4215 of the rotating plate 421 and arranged in two rows. The housing 431 includes two engaging tabs 4311, the two engaging tabs 4311 extend downward from a lower edge of the housing 431 and are arranged symmetrically, and as the housing 431 is assembled with the base 420, the two engaging tabs 4311 respectively correspond to two grooves 4211.

Therefore, after rotating the rotating plate 421 to adjust the height of the coupling member 410, through the engagement relation between the engaging tabs 4311 and the grooves 4211, the rotating plate 421 may be positioned, and relative movement between the rotating plate 421 and the bottom cover 422 may be avoided.

The rotating plate 421 may further include two elastic arms 4212 connected to the disc 4215 of the rotating plate 421, which may abut against the blocking sheet 4224 of the bottom cover 422 after the rotating plate 421 and the bottom cover 422 are assembled, thereby prohibiting the rotating plate 421 to separate from the bottom cover 422, one of the elastic arms 4212 is a left rotation limit for the rotating plate 421 to rotate relative to the bottom cover 422, and the other one of the elastic arms 4212 is a right rotation limit for the rotating plate 421 to rotate relative to the bottom cover 422.

Figure 19:
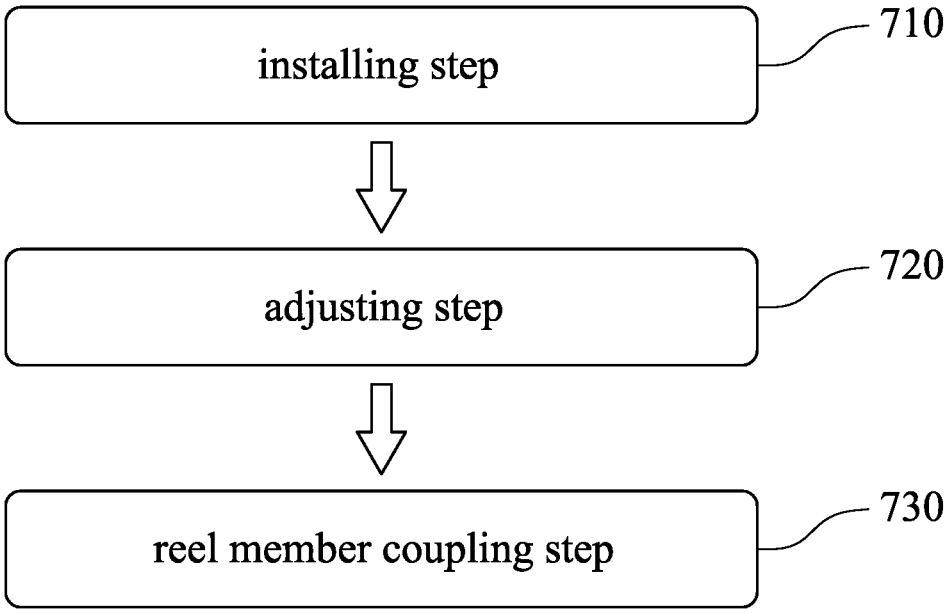
FIG. 19 shows a block flow chart of a fastening device installing and adjusting method according to a fifth embodiment of the present disclosure.

Please refer to FIG. 19, FIG. 19 shows a block flow chart of a fastening device installing and adjusting method 70 according to a fifth embodiment of the present disclosure. The fastening device installing and adjusting method 70 includes an installing step 710, an adjusting step 720 and a reel member coupling step 730.

In the installing step 710, a base and a coupling member of a fastening device is coupled to an article, and the coupling member is inserted into an installing hole of the article and a bore of the base.

In the adjusting step 720, the coupling member is moved in the bore, thereby narrowing a gap between the base and the article.

In the reel member coupling step 730, a reel member of the fastening device is coupled to the base.

The fastening device installing and adjusting method 70 will be described in detail with the first embodiment of FIGS. 1 to 8 and the third embodiment of FIGS. 11 to 14. As shown in FIGS. 1 to 8, the base 120 may include a bottom cover 122 and a rotating plate 121, the bottom cover 122 includes a bore 1225, the rotating plate 121 is movably coupled to the bottom cover 122, and therefore in the installing step 710, the coupling member 110 is inserted into the installing hole H1 of the article S1 and the bore 1225, thereby coupling the coupling member 110 to the rotating plate 121.

In the adjusting step 720, the rotating plate 121 may be rotated to move the coupling member 110 in the bore 1225, and the coupling member 110 is lifted to narrow the gap G1. Precisely, the tool T1 may be coupled to the rotating plate 121, such that at least one pawl arm 1214 of the rotating plate 121 is disengaged from at least one depression 1222 of the bottom cover 122, and then the tool T1 is rotating to rotate the rotating plate 121. Hence, the coupling member 110 may be guided by the engaging thread 1213 to move upward, switching from the lower end P1 to the higher end P2, and thereby the gap G1 between the base 120 and the article S1 is narrowed. As further shown in FIGS. 11 and 14, rotating the tool may rotate the rotating plate 321, the coupling member 310 may be wound around the winding track 3213, and the gap between the base 320 and the article S1 is narrowed, thereby firmly securing the base 320.

In addition, in the reel member coupling step 730, the reel member 130 may be coupled to a lace, and then the reel member 130 is connected to the base 120. The reel member 130 may include a knob (not labeled) and a spool (not shown), the knob may be operably coupled to the spool, the spool is for the lace to be wound therearound, and rotating the knob may tension or release the lace.

Figure 20:
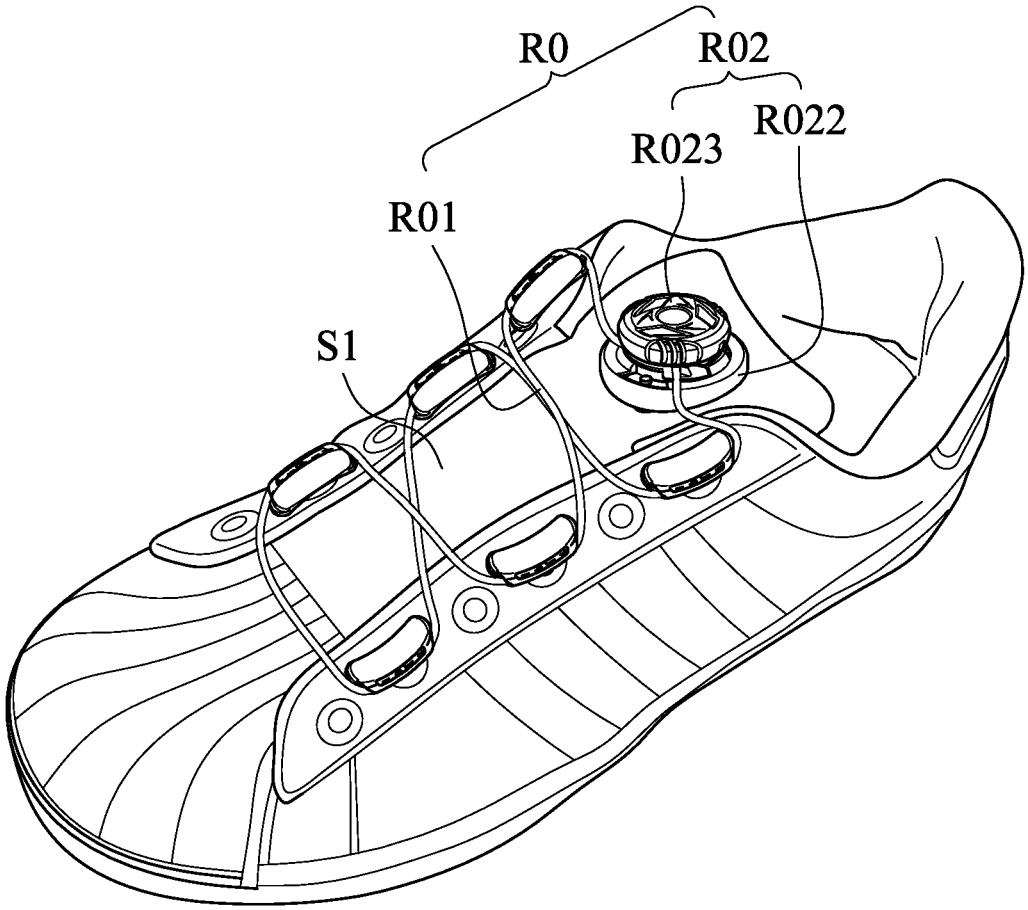
FIG. 20 shows a fastening system completed by the fastening device installing and adjusting method of the fifth embodiment of FIG. 19.

Please refer to FIG. 20, FIG. 20 shows a fastening system R0 completed by the fastening device installing and adjusting method 70 of the fifth embodiment of FIG. 19. The fastening system R0 includes a lace R01 and a fastening device R02, and the fastening device R02 may be for example the fastening device 10 or the fastening device 30. Before coupling the lace R01 to the reel member R023, the lace R01 may be coupled to guiding members (not labeled) at the article S1, and then the lace R01 is coupled the spool (not shown) in the reel member R023. After which, the reel member R023 is assembled with the base R022, such that the fastening system R0 is formed, and the lace R01 may be tensioned or released by the reel member R023, thereby fastening or loosening the article S1. As shown in FIG. 20, the article S1 is illustrated as a shoe, and although the lace R01 is coupled to the guiding members in FIG. 20, in other embodiments, the guiding members may be substituted for the eyelets, the article may for example be protective equipment, clothes, or other wearable articles worn on a worn article requiring to be tightened, and the present disclosure is not limited thereto.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A fastening device, applied for being installed at an article, the fastening device comprising:
- a base, located at the article and comprising:
  - a bottom cover, comprising a bore; and
  - a rotating plate, movably coupled to the bottom cover;
- a coupling member, inserting an installing hole of the article and the bore, and the coupling member coupled to the rotating plate; and
- a reel member, coupled to a lace and disposed at the base;
- wherein, the rotating plate is rotated to move the coupling member in the bore, thereby narrowing a gap between the base and the article.

2. The fastening device of claim 1, wherein the rotating plate comprises:
- a guiding curved-hole, configured for the coupling member to insert thereinto; and
- an engaging thread, protruding from an inner wall of the guiding curved-hole and coupled to the coupling member, the engaging thread comprising a higher end and a lower end, a distance between the higher end and a bottom surface of the rotating plate is wider than a distance between the lower end and the bottom surface;
- wherein, as the rotating plate is rotated, the coupling member is moved relative to the rotating plate from the lower end to the higher end.

3. The fastening device of claim 2, wherein the coupling member comprises an engaging cavity, and the engaging cavity is coupled to the engaging thread.

4. The fastening device of claim 1, wherein:
- the bottom cover further comprises:
  - a central hole; and
  - a plurality of depressions, located at an inner surface of the central hole; and
- the rotating plate comprises: at least one pawl arm, selectively engaged with at least one of the depressions;
- wherein, the at least one pawl arm is disengaged from the at least one of the depressions as being forced, thereby allowing the rotating plate to rotate relative to the bottom cover.

5. The fastening device of claim 1, wherein:
- the bottom cover further comprises:
  - a central protrusion; and
  - a plurality of depressions, located at an outer surface of the central protrusion; and
- the rotating plate comprises: at least one pawl arm, selectively engaged with at least one of the depressions;
- wherein, the at least one pawl arm is disengaged from the at least one of the depressions as being forced, thereby allowing the rotating plate to rotate relative to the bottom cover.

6. The fastening device of claim 1, wherein the coupling member has a cord structure and is wound around the rotating plate, and as the rotating plate is rotated, the coupling member is tensioned or released by the rotating plate.

7. The fastening device of claim 6, wherein the rotating plate comprises:
- an inserted passage, communicated with the bore and an external ambience, and the inserted passage being configured for receiving the coupling member.

* * * * *